United States Patent [19]

Horgan

[11] 4,415,639

[45] Nov. 15, 1983

[54] MULTILAYERED PHOTORESPONSIVE DEVICE FOR ELECTROPHOTOGRAPHY

[75] Inventor: Anthony M. Horgan, Pittsford, N.Y.

[73] Assignee: Xerox Corporation, Stamford, Conn.

[21] Appl. No.: 414,997

[22] Filed: Sep. 7, 1982

[51] Int. Cl.[3] ..... G03G 5/14

[52] U.S. Cl. ..... 430/57; 430/58; 430/59; 430/64; 430/65

[58] Field of Search ..... 430/57, 58, 59, 64, 430/65

[56] References Cited

U.S. PATENT DOCUMENTS

| | | | |
|---|---|---|---|
| 4,103,935 | 8/1978 | Petruzzella | 96/1.5 R |
| 4,265,990 | 5/1981 | Stolka et al. | 430/59 |
| 4,281,054 | 7/1981 | Horgan | 430/57 |

*Primary Examiner*—John D. Welsh
*Attorney, Agent, or Firm*—E. O. Palazzo

[57] ABSTRACT

This invention is directed to an improved photoresponsive device comprised of a substrate, a hole blocking layer, an optional adhesive layer, an inorganic photogenerating layer, an organic photoconductive layer sensitive to infra-red radiation, and a top coating of a hole transport layer. More specifically, the present invention is directed to an improved photoresponsive device comprised in the order stated of the following layers: (1) a conductive substrate, (2) a metal oxide hole blocking layer, (3) an adhesive layer, (4) an inorganic photogenerating layer, (5) a photoconductive composition capable of enhancing or reducing the intrinsic properties of the photogenerating layer, which composition is selected from the group consisting of organic photoconductive compositions, charge transfer complex compositions, sensitizers, or mixtures thereof, and (6) a hole transport layer.

30 Claims, 9 Drawing Figures

MULTILAYERED PHOTORESPONSIVE DEVICE FOR ELECTROPHOTOGRAPHY

BACKGROUND

This invention is generally directed to an improved overcoated layered photoresponsive device; and more specifically the present invention is directed to an improved layered photoresponsive device where the sensitivity thereof can be varied or enhanced, allowing such a device to be capable of being responsive to visible light, and infrared illumination needed for laser printing. In one important embodiment of the present invention, there is included in the device situated between a photogenerating layer and a hole transport layer or situated between a photogenerating layer, and a supporting substrate, a photoconductive composition, which composition is primarily responsible for enhancing or reducing the intrinsic properties of the photogenerating layer in the infra-red and/or visible range of the spectrum, thereby allowing such device to be sensitive to either visible light and/or infra-red wavelengths.

The formation and development of electrostatic latent images on the imaging surfaces of photoconductive materials by electrostatic means is well known, one such method involving the formation of an electrostatic latent image on the surface of a photosensitive plate, referred to in the art as a photoreceptor. This photoreceptor is generally comprised of a conductive substrate containing on its surface a layer of photoconductive material, and in many instances, a thin barrier layer is situated between the substrate and the photoconductive layer to prevent charge injection from the substrate, which injection would adversely affect the quality of the resulting image.

Numerous different xerographic photoconductive members are known including, for example, a homogeneous layer of a single material such as vitreous selenium, or a composite layered device, containing a dispersion of a photoconductive composition. An example of one type of composite xerographic photoconductive member is described for example, in U.S. Pat. No. 3,121,006, wherein there is disclosed finely divided particles of a photoconductive inorganic compound dispersed in an electrically insulating organic resin binder. In a commercial form, the binder layer contains particles of zinc oxide uniformly dispersed in a resin binder, and coated on a paper backing. The binder materials disclosed in this patent comprise a material which is incapable of transporting for any significant distance injected charge carriers generated by the photoconductive particles. Accordingly, as a result the photoconductive particles must be in a substantially contiguous particle to particle contact throughout the layer for the purpose of permitting charge dissipation required for a cyclic operation. Thus, with the uniform dispersion of photoconductive particles described a relatively high volume concentration of photoconductor material, about 50 percent by volume, is usually necessary in order to obtain sufficient photoconductor particle to particle contact for rapid discharge. This high photoconductive loading can result in destroying the physical continuity of the resin, thus significantly reducing the mechanical properties of the binder layer. Illustrative examples of specific binder materials disclosed in this patent include, for example, polycarbonate resins, polyester resins, polyamide resins, and the like.

There are also known photoreceptor materials comprised of other inorganic or organic materials wherein the charge carrier generation and charge carrier transport functions are accomplished by discrete contiguous layers. Additionally, layered photoreceptor materials are disclosed in the prior art which include an overcoating layer of an electrically insulating polymeric material. However, the art of xerography continues to advance and more stringent demands need to be met by the copying apparatus in order to increase performance standards, and to obtain higher quality images. Also, there is desired layered photoresponsive devices which are responsive to visible light and infra-red illumination needed for laser printing.

Recently, there has been disclosed layered photoresponsive devices including those comprised of generating layers and transport layers as disclosed in U.S. Pat. No. 4,265,990, and overcoated photoresponsive materials containing a hole injecting layer, overcoated with a transport layer, followed by an overcoating of a photogenerating layer and a top coating of an insulating organic resin, reference U.S. Pat. No. 4,251,612. Examples of generating layers disclosed in these patents include trigonal selenium, and phthalocyanines, and examples of transport layers that may be employed are comprised of certain diamines as mentioned herein. The disclosures of each of these patents, namely, U.S. Pat. Nos. 4,265,990 and 4,251,612 are totally incorporated herein by reference.

Many other patents are in existence describing photoresponsive devices including layered devices containing generating substances, such as U.S. Pat. No. 3,041,167, which discloses an overcoated imaging member containing a conductive substrate, a photoconductive layer, and an overcoating layer of an electrically insulating polymeric material. This member is utilized in an electrophotographic copying method by, for example, initially charging the member, with an electrostatic charge of a first polarity, and imagewise exposing to form an electrostatic latent image, which can be subsequently developed to form a visible image. Prior to each succeeding imaging cycle, the imaging member can be charged with an electrostatic charge of a second polarity which is opposite in polarity to the first polarity. Sufficient additional charges of the second polarity are applied so as to create across the member a net electrical field of the second polarity. Simultaneously, mobile charges of the first polarity are created in the photoconductive layer such as by applying an electrical potential to the conductive substrate. The imaging potential which is developed to form the visible image is present across the photoconductive layer and the overcoating layer.

There is also disclosed in Belgium Pat. No. 763,540, an electrophotographic member having at least two electrically operative layers, the first layer comprising a photoconductive layer which is capable of photogenerating charge carriers, and injecting these carriers into a continuous active layer containing an organic transporting material which is substantially non-absorbing in the spectral region of intended use, but which is active in that it allows injection of photogenerating holes from the photoconductive layer, and allows these holes to be transported through the active layer. Additionally, there is disclosed in U.S. Pat. No. 3,041,116 a photoconductive material containing a transparent plastic material overcoated on a layer of vitreous selenium contained on a substrate.

Further, there is disclosed in U.S. Pat. Nos. 4,232,102, and 4,233,383, photoresponsive imaging members comprised of trigonal selenium doped with sodium carbonate, sodium selenite mixtures, and barium carbonate, barium selenite mixtures.

Other representative patents disclosing layered photoresponsive devices include U.S. Pat. Nos. 4,115,116, 4,047,949 and 4,081,274.

While the above-described photoresponsive devices are suitable for their intended purposes there continues to be a need for the development of improved devices, particularly layered devices, which not only generate acceptable images, but which can be repeatedly used in a number of imaging cycles without deterioration thereof from the machine environment or surrounding conditions. Additionally, there continues to be a need for improved layered imaging members wherein the materials selected for the respective layers are substantially inert to users of such devices, while simultaneously functioning as an imaging member. Furthermore, there continues to be a need for imaging members wherein adhesion of the layers such as, for example, the photogenerating layer to the substrate can be accomplished without the need for specific adhesive materials, while simultaneously improving the scratch resistance of the other layers such as the ground plane layer, and improving the strength of the binder generating layer. Also, there continues to be a need for overcoated photoresponsive devices which are sensitive to a broad range of wavelengths, and more specifically are sensitive to infra-red light, and visible light, thereby allowing such devices to be utilized in a number of imaging and printing systems. Further, there continues to be a need for improved photoresponsive devices which can be prepared with a minimum number of processing steps, and wherein the layers are sufficiently adhered to one another to allow the continuous use of such devices in repetitive imaging and printing systems.

SUMMARY OF THE INVENTION

It is therefore an object of the present invention to provide an improved photoresponsive member which overcomes the above-noted disadvantages.

It is yet another object of the present invention to provide an improved layered photoresponsive device which is panchromatic, and thus sensitive to visible light as well as infra-red light.

A further specific object of the present invention is the provision of an improved overcoated layered photoresponsive device containing a photoconductive composition situated between a hole transport layer and a photogenerating layer.

It is yet another object of the present invention to provide an improved layered overcoated photoresponsive device containing a photoconductive composition situated between a photogenerating layer and a supporting substrate layer of such a device.

Another object of the present invention resides in the provision of an improved overcoated photoresponsive device containing a photoconductive composition situated between a hole transport layer and a photogenerating layer, which device is simultaneously responsive to infra-red light and visible light, and wherein the device has improved adhesion properties.

In yet another object of the present invention there is provided imaging and printing methods utilizing the improved overcoated photoresponsive device of the present invention.

These and other objects of the present invention are accomplished by the provision of an improved photoresponsive device comprising a layer of a photoconductive composition situated between a photogenerating layer and a hole transport layer, or wherein the photoconductive composition layer is situated between the photogenerating layer and the supporting substrate of such a device. The improved photoresponsive device of the present invention thus contains a photoconductive composition layer which serves to enhance or reduce the intrinsic properties of the photogenerating layer, in the infra-red and/or visible range of the spectrum.

In one specific embodiment, the present invention is directed to an improved photoresponsive device comprised in the order stated of (1) a substrate, (2) a hole blocking layer, (3) an optional adhesive interface layer, (4) an inorganic photogenerating layer, (5) a photoconductive composition layer capable of enhancing or reducing the intrinsic properties of the photogenerating layer, which composition is selected from the group consisting of organic photoconductive materials, charge transfer complex materials, and sensitizers, and (6) a hole transport layer. In one important illustrative embodiment of the present invention, the photoresponsive device is comprised of a conductive supporting substrate, a hole blocking metal oxide layer in contact therewith, an adhesive layer, an inorganic photoconductive photogenerating material overcoated on the adhesive layer, a photoconductive composition capable of enhancing or reducing the intrinsic properties of the photogenerating layer in the infra-red and/or visible range of the spectrum, which composition is comprised of a photoconductive material containing organic photoconductive substances, charge transfer complexes, sensitizers, or mixtures thereof, and as a top layer a hole transport layer comprised of certain diamines dispersed in a resinous matrix. The photoconductive composition layer in contact with the hole transport layer must be capable of allowing holes generated by the photogenerating layer to be transported, and also this layer should not trap the generated holes. Further, the photoconductive composition layer should be comprised of materials that have transmissive properties, that is materials that allow the passage of the light required to produce electron hole pairs in the photogenerating layer. Also, the photoconductive layer can function as a selective filter, allowing light of a certain wavelength to penetrate to the photogenerating layer.

In another important embodiment, the present invention is directed to an improved photoresponsive device as described hereinbefore, with the exception that the photoconductive composition capable of enhancing or reducing the intrinsic properties of the photogenerating layer is situated between the photogenerating layer, and the supporting substrate contained in the device. Accordingly, in this variation, the photoresponsive device of the present invention comprises in the order stated (1) a substrate, (2) a hole blocking layer, (3) an optional adhesive, or adhesion interface layer, (4) a photoconductive composition layer capable of enhancing or reducing the intrinsic properties of the photogenerating layer in the infra-red and/or visible range of the spectrum, which composition is comprised of organic photoconductive materials, charge transfer complex materials, sensitizers, or mixtures thereof, (5) an inorganic photogenerating layer, and (6) a hole transport layer.

Exposure to illumination and erasure, of the layered photoresponsive devices of the present invention may be accomplished from the frontside, from the rearside, or combinations thereof.

The improved photoresponsive devices of the present invention can be prepared by a number of known methods, the process parameters and the order of the coating of the layers being dependent on the device desired. Thus, for example, the improved photoresponsive device of the present invention can be prepared by providing a conductive substrate containing a hole blocking layer, and an optional adhesive layer, and applying thereto by solvent coating processes, laminating processes, or other methods, a photogenerating layer, an organic photoconductive composition capable of enhancing or reducing the intrinsic properties of the photogenerating layer in the infra-red and/or visible range of the spectrum, and a hole transport layer.

The improved photoresponsive device of the present invention can be incorporated in various imaging systems and more importantly can function simultaneously in imaging and printing systems with visible light and/or infra-red light. Thus, the improved photoresponsive device of the present invention may be negatively charged, exposed to light in a wavelength range of from about 400 to about 1,000 nanometers, either sequentially or simultaneously, followed by developing the resultant image, and transferring to paper. The above sequence may be repeated many times.

BRIEF DESCRIPTION OF THE DRAWINGS

For a better understanding of the present invention and further features thereof, reference is made to the following detailed description of various preferred embodiments wherein:

FIG. 7 illustrates the percent discharge for the photoresponsive device of Example V for 5 ergs $cm^{-2}$ exposure from a dark development potential ($V_{DDP}$) of $-800$ volts as a function of light exposure in the wavelength of 400 nanometers to 1,000 nanometers. This device has no infra-red sensitivity.

FIG. 8 illustrates the percent discharge for the photoresponsive device of Example VI for 5 ergs $cm^{-2}$ exposure from a dark development potential ($V_{DDP}$) of $-800$ volts as a function of light exposure in the wavelength of from about 400 nanometers to about 1,000 nanometers. This figure demonstrates that such a device possesses red and infra-red sensitivity, but lacks good blue and green sensitivity.

FIG. 9 represents the percent discharge for the photoresponsive device of the present invention, reference Example X, for 5 ergs $cm^{-2}$ exposure of this device from a dark development potential ($V_{DDP}$) of $-800$ volts as a function of light exposed in the wavelength of 400 to 1,000 nanometers. This figure demonstrates the visible and infra-red sensitivity of the devices of the present invention.

The percent discharge referenced in the Figures is defined as $$\frac{V_{DDP}(-800\text{ volts}) - V\ 5\text{ ergs cm}^{-2}}{V_{DDP}(-800\text{ volts})} \times 100$$

wherein $V_{DDP}$ is the dark development potential, and V (volts) 5 ergs $cm^{-2}$ is the surface potential in volts on the photoreceptor after exposure to 5 ergs $cm^{-2}$ of light in the wavelength range 400 to 1,000 nanometers.

As an example, for a $V_{DDP}$ of $-800$ volts and a surface potential of 400 volts, after 5 ergs $cm^{-2}$ exposure at, for example 800 nanometers, the percent discharge of the device involved would be 50 percent.

DESCRIPTION OF THE PREFERRED EMBODIMENTS

Figure 1:
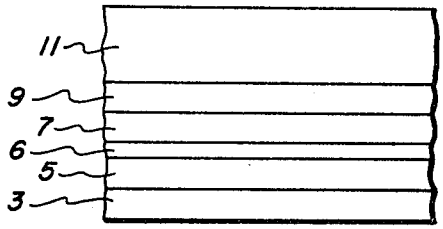
FIGS. 1 and 2 are partially schematic cross-sectional views of the improved photoresponsive device of the present invention.

Illustrated in FIG. 1 is the improved photoresponsive device of the present invention, generally designated 10, and comprising a substrate 3, a hole blocking metal oxide layer 5, an optional adhesive layer 6, a charge carrier inorganic photogenerating layer 7, an organic photoconductive composition layer 9 capable of enhancing or reducing the intrinsic properties of the photogenerating layer 7 in the infra-red and/or visible range of the spectrum, and a charge carrier, or hole transport layer 11.

Figure 2:
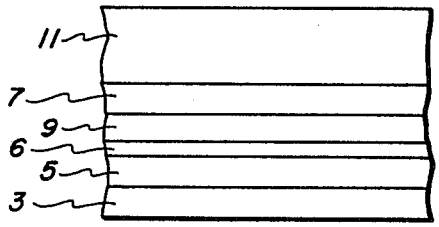

Illustrated in FIG. 2 is essentially the same device as illustrated in FIG. 1 with the exception that the photoconductive layer 9 is situated between the inorganic photogenerating layer 7 and the substrate 3, and more specifically, the photoconductive layer 9 in this embodiment is specifically situated between the optional adhesive layer 6 and the charge carrier inorganic photogenerating layer 7.

The substrate layer 3 may be opaque or substantially transparent, and may comprise any suitable material having the requisite mechanical properties. Thus the substrate may comprise a layer of insulating material such as an inorganic or organic polymeric material; a layer of an organic or inorganic material having a semiconductive surface layer such as indium tin oxide, arranged thereon, or a conductive material such as, for example, aluminum, chromium, nickel, brass or the like. The substrate may be flexible or rigid and many have a number of many different configurations, such as, for example, a plate, a cylindrical drum, a scroll, an endless flexible belt and the like. Preferably, the substrate is in the form of an endless flexible belt. In some situations, it may be desirable to coat on the back of the substrate, particularly when the substrate is an organic polymeric material, an anti-curl layer, such as for example, polycarbonate materials commercially available as Makrolon.

The thickness of the substrate layer depends on many factors, including economical considerations, and this layer may be of substantial thickness, for example, over 100 mils, or of minimum thickness, providing there are no adverse effects on the system. In one preferred embodiment the thickness of this layer ranges from about 3 mils to about 10 mils.

The hole blocking metal oxide layer 5 can be comprised of various suitable known materials including aluminum oxide, and the like. The preferred metal oxide layer is aluminum oxide. The primary purpose of this layer is to provide hole blocking, that is to prevent hole injection from the substrate during and after charging. Typically, this layer is of a thickness of less than 50 Angstroms.

Adhesive layer 6, is typically a polymeric material, including polyesters, polyvinyl butyral, polyvinyl pyrrolidone and the like. Typically, this layer is of a thickness of less than about 0.3 microns.

The inorganic photogenerating layer 7 can be comprised of known photoconductive charge carrier generating materials sensitive to visible light, such as amorphous selenium, amorphous selenium alloys, halogen doped amorphous selenium, halogen doped amorphous selenium alloys, trigonal selenium, mixtures of Groups IA and IIA element, selenite and carbonates with trigonal selenium, reference U.S. Pat. Nos. 4,232,102 and 4,233,283, cadmium sulphide, cadmium selenide, cadmium telluride, cadmium sulfur selenide, cadmium sulfur telluride, cadmium seleno telluride, copper, and chlorine doped cadmium sulphide, cadmium selenide and cadmium sulphur selenide and the like. Alloys of selenium included within the scope of the present invention include selenium tellurium alloys, selenium arsenic alloys, selenium tellurium arsenic alloys, and preferably such alloys containing a halogen material such as chlorine in an amount of from about 50 to about 200 parts per million.

Layer 7 typically has a thickness of from about 0.05 microns to about 10 microns or more, and preferably from about 0.4 microns to about 3 microns, however, the thickness of this layer is primarily dependent on the photoconductive volume loading, which may vary from 5 to 100 volume percent. Generally, it is desirable to provide this layer in a thickness which is sufficient to absorb about 90 percent or more of the incident radiation which is directed upon it in the imagewise or printing exposure step. The maximum thickness of this layer is dependent primarily upon factors such as mechanical considerations, for example whether a flexible photoresponsive device is desired.

A very important layer of the photoresponsive device of the present invention is the photoconductive layer 9 which can be comprised of numerous organic photoconductive substances, charge transfer complexes, squarylium pigments, various sensitizers, mixtures thereof and the like. Illustrative examples of materials useful in this layer include metal phthalocyanines, metal free phthalocyanines, vanadyl phthalocyanines, other known phthalocyanines, as disclosed in U.S. Pat. No. 3,816,118, the disclosure of which is totally incorporated herein by reference, squarylium pigments, charge transfer complex materials such as polyvinyl carbazole-trinitrofluoronone, particularly polyvinyl carbazole 2,4,7-trinitrofluoronone, and various infra-red sensitizers, such as cyanine dyes, described in the *Chemistry of Synethtic Dyes,* Volume II and Volume IV, 1971, Academic Press, edited by K. Venkataraman.

Specific illustrative examples of squarylium pigments that can be selected for layer 9 include, for example, those of the following formula:

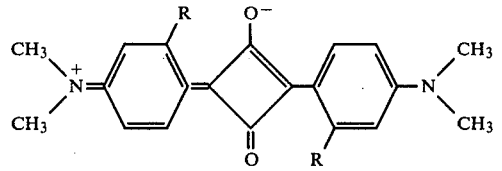

wherein R is hydrogen, an alkyl group such as methyl, or a hydroxy (OH) group.

The materials selected for layer 9, reference FIG. 1, must be electronically compatible with the charge carrier transport layer 11, in order that photoexcited charge carriers can be injected into the transport layer, and further, in order that charge carriers can travel in both directions across the interface between the photoconductive layer 9, and the charge transport layer 11. One preferred material for layer 9 that accomplishes these functions is vanadyl phthalocyanine, primarily since it is readily available, and provides the desired level of enhancement of the intrinsic properties of the photogenerating layer, in the infra-red range of the spectrum, about 700 nanometers to about 920 nanometers.

The inorganic photogenerating materials for layer 7, or the photoconductive materials for layer 9, can comprise 100 percent of the respective layers, or these materials can be dispersed in various suitable inorganic or resinous polymer binder materials, in amounts of from about 5 percent by volume to about 95 percent by volume, and preferably in amounts of from about 25 percent by volume to about 75 percent by volume. Illustrative examples of polymeric binder resinous materials that can be selected include those as disclosed, for example, in U.S. Pat. No. 3,121,006, the disclosure of which is totally incorporated herein by reference, polyesters, polyvinyl butyral, Formvar®, polycarbonate resins, polyvinyl carbazole, epoxy resins, phenoxy resins, especially the commercially available poly(hydroxyether) resins.

In one embodiment of the present invention, the charge carrier transport material, such as the diamine described hereinafter, may be incorporated into layer 7, and/or layer 9, in amounts for example, ranging from about zero volume percent to 60 volume percent.

Generally, the thickness of layer 9 depends on a number of factors including the thicknesses of the other layers, and the percent mixture or photoconductive material contained in this layer. Accordingly, this layer can range in thickness of from about 0.05 microns to about 10 microns when a photoconductive composition such as vanadyl phthalocyanine is present in an amount of from about 5 percent to about 100 percent by volume, and preferably this layer ranges in thickness of from about 0.25 microns to about 1 micron, when the photoconductive composition such as vanadyl phthalocyanine is present in this layer in an amount of 30 percent by volume. The maximum thickness of this layer is dependent primarily upon factors such as mechanical considerations, for example whether a flexible photoresponsive device is desired.

Charge carrier transport layer 11 can be comprised of a number of numerous suitable materials which are capable of transporting holes, this layer generally having a thickness in the range of from about 5 microns to about 50 microns, and preferably from about 20 microns to about 40 microns. In a preferred embodiment, this transport layer comprises molecules of the formula:

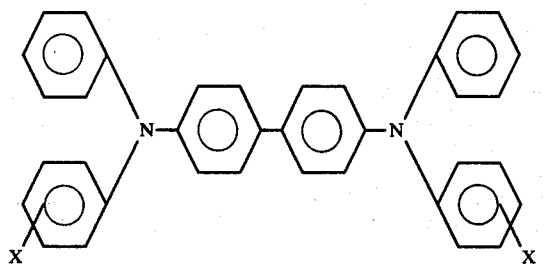

dispersed in a highly insulating and transparent organic resinous binder wherein X is selected from the group consisting of (ortho) $CH_3$, (meta) $CH_3$, (para) $CH_3$, (ortho) Cl, (meta) Cl, (para) Cl. The highly insulating resin, which has a resistivity of at least $10^{12}$ ohm-cm to prevent undue dark decay, is a material which is not necessarily capable of supporting the injection of holes from the photogenerating layer, and is not capable of allowing the transport of these holes through the material. However, the resin becomes electrically active when it contains from about 10 to 75 weight percent of the substituted N,N,N',N'-tetraphenyl[1,1-biphenyl]4-4'-diamines corresponding to the foregoing formula.

Compounds corresponding to the above formula include, for example, N,N'-diphenyl-N,N'-bis(alkylphenyl)-[1,1-biphenyl]-4,4'-diamine wherein the alkyl is selected from the group consisting of methyl such as 2-methyl, 3-methyl and 4-methyl, ethyl, propyl, buyl, hexyl and the like. In the case of chloro substitution, the compound is named N,N'-diphenyl-N,N'-bis(halo phenyl)-[1,1'-biphenyl]-4,4'-diamine wherein the halo atom is 2-chloro, 3-chloro or 4-chloro.

Other electrically active small molecules which can be dispersed in the electrically inactive resin to form a layer which will transport holes include, bis(4-diethylamine-2-methylphenyl)phenylmethane; 4',4''-bis(diethylamino)-2'2''-dimethyltriphenyl methane; bis-4(diethylaminophenyl)phenylmethane; and 4,4'-bis(diethylamino)-2,2'-dimethyl triphenylmethane.

Providing the objectives of the present invention are achieved, other charge carrier transport molecules can be selected for layer 11.

Examples of the highly insulating and transparent resinous material or inactive binder resinous material, for layer 11, include materials such as those described in U.S. Pat. No. 3,121,006 the disclosure of which is totally incorporated herein by reference. Specific examples of organic resinous materials include polycarbonates, acrylate polymers, vinyl polymers, cellulose polymers, polyesters, polysiloxanes, polyamides, polyurethanes and epoxies as well as block, random or alternating copolymers thereof. Preferred electrically inactive binder materials are polycarbonate resins having a molecular weight ($M_w$) of from about 20,000 to about 100,000 with a molecular weight in the range of from about 50,000 to about 100,000 being particularly preferred. Generally, the resinous binder contains from about 10 to about 75 percent by weight of the active material corresponding to the foregoing formula, and preferably from about 35 percent to about 50 percent of this material.

Figure 3:
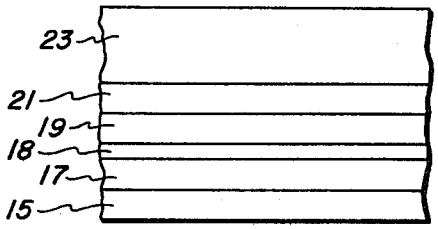
FIG. 3 is a partially schematic cross-sectional view of a preferred photoresponsive device of a present invention.

Illustrated in FIG. 3 is one preferred photoresponsive device of the present invention wherein the substrate 15 is comprised of Mylar in a thickness of 3 mils, containing a layer of 20 percent transmissive aluminum in a thickness of about 100 Angstroms, the metal oxide layer 17 is comprised of aluminum oxide in a thickness of about 20 Angstroms, layer 18 is a polyester adhesive interface commercially available from E. I. duPont, as 49,000 polyester in a thickness of about 0.05 microns, the inorganic photogenerating layer 19 is of a thickness of about 2.0 microns and is comprised of 10 volume percent $Na_2SeO_3$ and $Na_2CO_3$ doped trigonal selenium in a polyvinyl carbazole binder, the photoconductive layer 21 has a thickness of about 0.5 microns, and is comprised of 30 volume percent vanadyl phthalocyanine dispersed in a polyester binder, 70 volume percent, and the hole transport layer 23, thickness about 25 microns is comprised of 50 weight percent N,N'-diphenyl-N,N'-bis(3-methylphenyl)-[1,1'-biphenyl]-4,4'-diamine, dispersed in a polycarbonate resinous binder.

Figure 4:
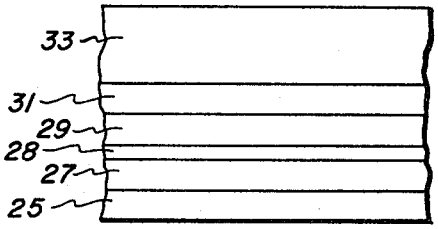
FIG. 4 illustrates a further preferred embodiment of the photoresponsive device of the present invention.

Illustrated in FIG. 4 is another preferred photoresponsive device of the present invention, wherein layers 25, 27, 28, 29 and 33 are identical to layers 15, 17, 18, 19 and 23, as described with reference to FIG. 3. In FIG. 4, the photoconductive layer 31, rather than being vanadyl phthalocyanine, is comprised of about 30 volume percent of hydroxy squarylium dispersed in a resinous binder material, 70 volume percent commercially available as Formvar® from Monsanto Chemical Company.

Figure 5:
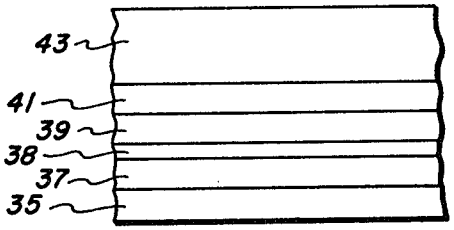
FIG. 5 illustrates another preferred embodiment of the photoresponsive device of the present invention.

There is illustrated in FIG. 5 a further embodiment of the photoresponsive device of the present invention, wherein the substrate 35, is comprised of Mylar in a thickness of 3 mils, containing about a 100 Angstrom layer of 20 percent transmissive aluminum, the metal oxide hole blocking layer 37 is aluminum oxide in a thickness of about 20 Angstroms, the optional adhesive layer 38 is a polyester material commercially available from E. I. duPont Company, as duPont 49,000, this layer having a thickness of about 0.05 microns, the photogenerating layer 39 is comprised of 33 percent by volume of trigonal selenium dispersed in a phenoxy resinous binder, commercially available as the poly(hydroxyether) Bakelite from Allied Chemical Corporation, this layer having a thickness of 0.4 microns, a photoconductive layer 41, comprised of 30 percent by volume of vanadyl phthalocyanine dispersed in a polyester binder, which layer has a thickness of about 0.5 microns, and a hole transport layer 43, in a thickness of 25 microns, comprised of 50 percent by weight of N,N'-diphenyl-N,N'-bis(3-methylphenyl)-[1,1'-biphenyl]-4,4'-diamine, dispersed in a polycarbonate resinous binder.

Figure 6:
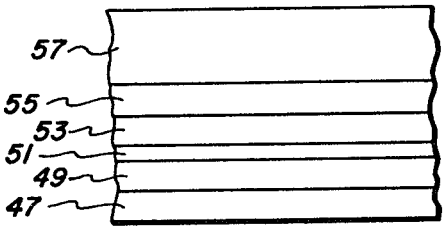
FIG. 6 illustrates another preferred embodiment of the photoresponsive device of the present invention.

Illustrated in FIG. 6 is a further preferred photoresponsive device of the present invention, wherein the layers 47, 49, 51, 53 and 57, are identical to the layers 35, 37, 38, 39 and 43, which reference to FIG. 5. In FIG. 6 the photoconductive layer 55 is comprised of 30 volume percent of hydroxy squarylium dispersed in the resinous binder Formvar®.

Figure 7:
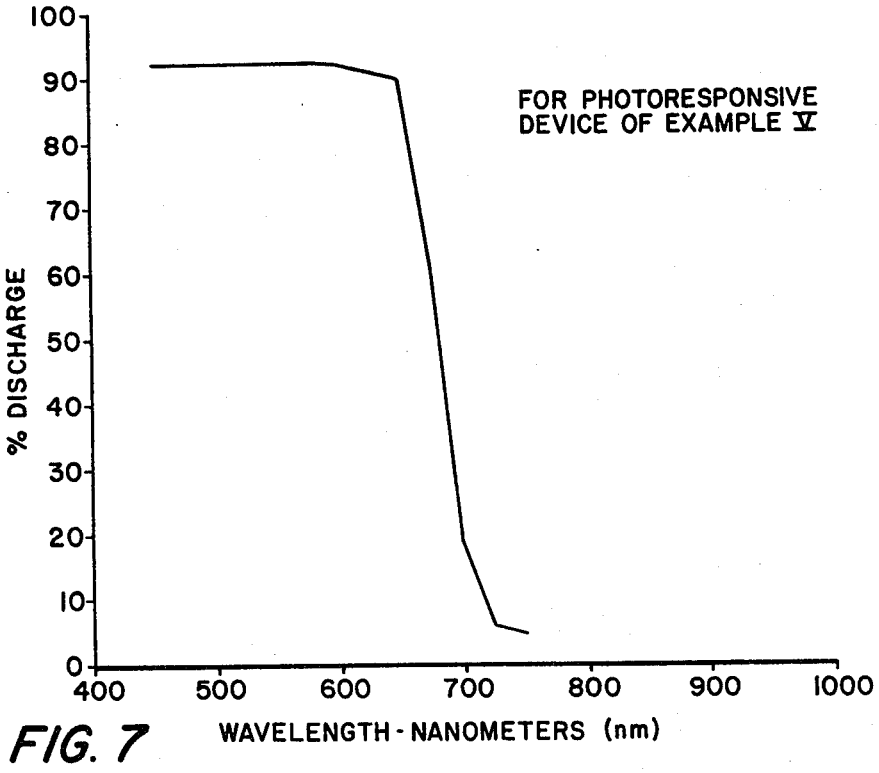
FIGS. 7, 8 and 9 are spectral response curves wherein there is plotted for various photoresponsive devices, photosensitivity as a function of wavelength.
Figure 8:
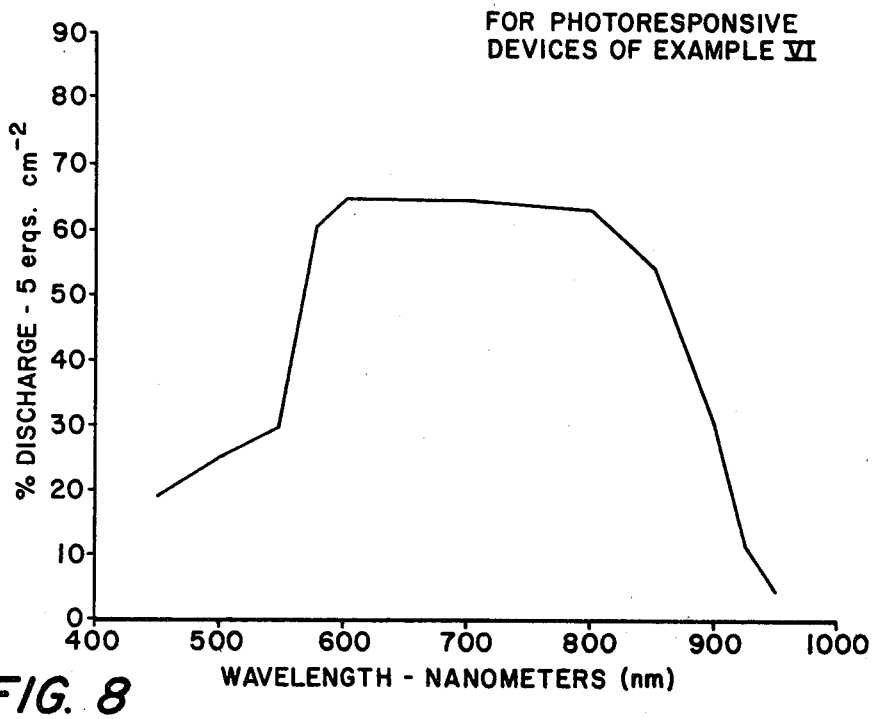
Figure 9:
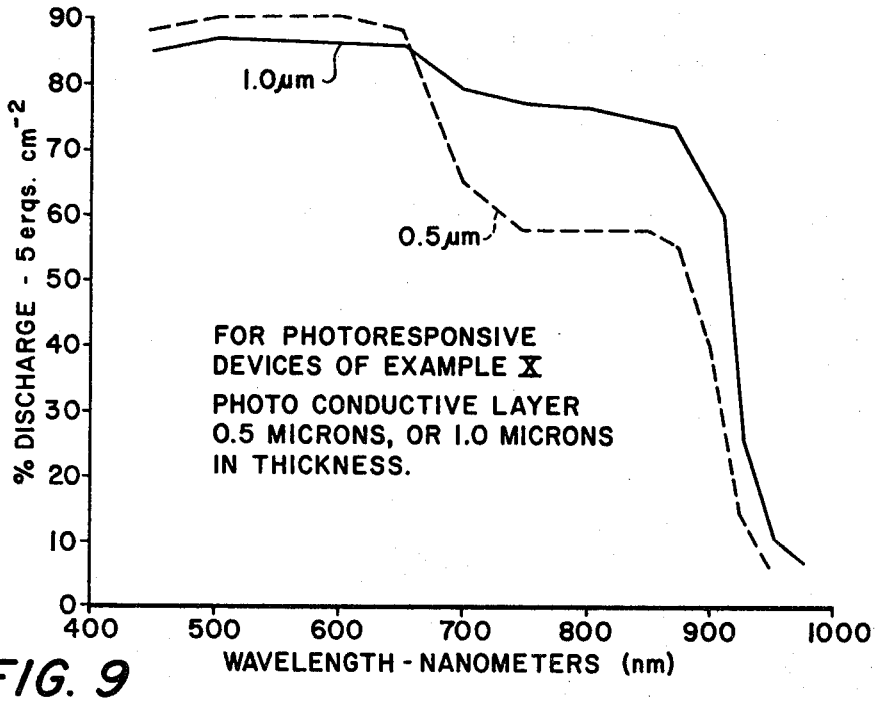

As indicated herein, illustrated in FIGS. 7, 8, and 9, are spectral response graphs or curves wherein the photosensitivity of various photoresponsive devices are plotted as a function of wavelength.

Illustrated in FIG. 7 is a photoresponsive device prepared in accordance with Example V, and containing a Mylar substrate, 3 mils in thickness, a layer of 20 percent transmissive aluminum, about 100 Angstrom units in thickness, a hole blocking layer of aluminum oxide of about 20 Angstrom units in thickness, an adhesive layer of a polyester material, commercially available from E. I. duPont as duPont 49,000, of a thickness of about 0.05 microns, and a generating layer, 0.4 microns thick, containing 33 percent by volume of trigonal selenium dispersed in phenoxy resinous binder, commercially available as a poly(hydroxyether) from Allied Chemical Company, and a transport layer, 25 microns in thickness comprised of 50 weight percent of N,N'-diphenyl-N,N'-bis(3-methylphenyl)-[1,1'-biphenyl]-4,4'-diamine dispersed in a polycarbonate resinous binder, which device has essentially no infra-red sensitivity in that at a wavelength of about 700 nanometers, the percent discharge of this device is substantially zero.

Illustrated in FIG. 8 is a photoresponsive device prepared in accordance with Example VI, and containing a Mylar substrate, in a thickness of 3 mils, a layer of 20 percent transmissive aluminum, in a thickness of about 100 Angstrom units, a hole blocking layer of aluminum oxide, in a thickness of about 20 Angstrom units, an adhesive layer of a polyester material, commercially available as duPont 49,000, in a thickness of about 0.05 microns, overcoated with a photogenerating layer of vanadyl phthalocyanine, 30 percent by volume dispersed in a polyester resinous binder, about 0.5 microns in thickness, which in turn is overcoated with a transport layer, 25 microns in thickness comprised of 50 percent by weight of N,N'-diphenyl-N,N'-bis(3-methylphenyl)-[1,1'-biphenyl]-4,4'-diamine dispersed in a polycarbonate resinous binder, which device had poor visible blue and green sensitivity as evidenced by a discharge percentage of less than 30 at wavelengths of less than 550 nanometers, for example.

Illustrated in FIG. 9 is a photoresponsive device of the present invention as prepared in accordance with Example X, and containing the subtrate, 3 mils in thickness, a layer of 20 percent transmissive aluminum, about 100 Angstrom units in thickness, a hole blocking layer of aluminum oxide, in a thickness of about 20 Angstrom units, an adhesive layer of a polyester, commercially available as duPont 49,000, in a thickness of about 0.05 microns, a generating layer, 0.4 microns thick, containing 33 percent by volume of trigonal selenium, dispersed in a phenoxy resinous binder, commercially available as a poly(hydroxyether) Bakelite from Allied Chemical Corporation, overcoated with a photoconductive layer of vanadyl phthalocyanine, 30 percent by volume dispersed in a polyester resinous binder, about 0.5 microns in thickness or overcoated with a photoconductive layer of vanadyl phthalocyanine 30 percent by volume, dispersed in a polyester resinous binder, about 1.0 microns in thickness, and a transport layer, 25 microns in thickness comprised of 50 percent by weight of N,N'-diphenyl-N,N'-bis(3-methylphenyl)-[1,1'-biphenyl]-4,4'-diamine dispersed in a polycarbonate resinous binder. This device has sensitivity both in the visible range of the spectrum, a wavelength of from about 400 nanometers to about 700 nanometers, as well as sensitivity in the infra-red region, that is from about 700 to about 950 nanometers.

The invention will now be described in detail with respect to specific preferred embodiments thereof, it being understood that these examples are intended to be illustrative only, and the invention is not intended to be limited to the materials, conditions, or process parameters, recited herein. All parts and percentages are by weight unless otherwise indicated.

EXAMPLE I

Preparation of N,N-diphenyl-N,N'-bis(3-methylphenyl)-[1,1'-biphenyl]-4,4'-diamine In a 5,000 milliliter (ml), round bottom 3, necked flask fitted with a mechanical stirrer and blanketed with argon, is placed 336 grams (1 mole) of N,N'-diphenyl[1,1'-biphenyl]-4,4'-diamine, 550 grams (2.5 moles) of m-iodotoluene, 550 grams (4 moles) potassium carbonate (anhydrous), 50 grams of a copper bronze catalyst, and 1,500 ml dimethylsulfoxide (anhydrous). The heterogeneous mixture is refluxed for 6 days. The mixture is allowed to cool, and 200 ml of benzene is added. The dark slurry is then filtered. The filtrate is extracted 4 times with water. Then the filtrate is dried with magnesium sulfate and filtered. The benzene is taken off under reduced pressure. The black product is column chromatographed using Woelm neutral alumina. Colorless crystals of the above diame product are obtained by recrystallizing the product from n-octane. The melting point is 167. 169° C. The yield is 360 grams (65 percent).

Analytical Calculation for $C_{38}H_{32}N_2$: C, 88.34; H, 6.24; N, 5.37. Found: C, 88.58; H, 6.21; N, 5:37.

EXAMPLE II

Preparation of N,N-diphenyl-N,N'-bis(4-methylphenyl)-[1,1'-biphenyl]4,4'-diamine In a 500 milliliter, round bottom flask, equipped with a magnetic stirrer and purged with argon, is charged with 20 grams of p,p-diiodobiphenyl (0.05 mole), 18.3 grams of p-tolylphenyl-amine (0.1 mole), 20.7 grams potassium carbonate (anhydrous) (0.15 mole), 3.0 grams of copper powder and 50 mils of sulfolane (tetrahydrothiophene-1,1-dioxide). The mixture is heated to 220°–225° C. for 24 hours, allowed to cool to approximately 150° C. and 300 milliliters of deionized water are added. The heterogeneous mixture is heated to reflux while vigorously stirring. A light tan oily precipitate is formed in the flask. The water is then decanted. Then 300 milliliters of water are added, and the water layer was again decanted. 300 milliliters of methanol was added and the mixture was refluxed to dissolve any unreacted starting materials. The solids were filtered off, added to 300 milliliters of n-octane and heated to a reflux temperature of 125° C. The solution was filtered through 100 grams of neutral Woelm alumina to give a pale yellow filtrate. The solution was again filtered through 100 grams of neutral Woelm alumina to yield a colorless filtrate and was allowed to cool yielding colorless crystals of the intended compound having a M.P. of 163°–165° C.

Analytical Calculation for $C_{38}H_{32}N_2$: C, 88.34; H, 6.24; N, 5.37. Found: C, 88.49; H, 6.44; N, 5:28.

EXAMPLE III

A photoreceptive device was prepared by providing an aluminized Mylar substrate in a thickness of 3 mils, and applying thereto, wet thickness, 0.5 mils, a layer of 0.5 weight percent duPont 49,000 adhesive, a polyester available from E. I. duPont, in methylene chloride and 1,1,2-trichloroethane (4:1 volume ratio) with a Bird applicator. This layer was allowed to dry for one minute at room temperature, and 10 minutes at 100° C. in a forced air oven, resulting in a layer having a dry thickness of about 0.05 microns.

There was then overcoated on the adhesive layer 10 volume percent of a photogenerating layer comprised of trigonal selenium prepared as follows:

In a 2 oz. amber bottle there was added 0.8 grams polyvinyl carbazole and 14 milliliters, 1:1 volume ratio, tetrahydrofuran and toluene. There was then added to this solution 0.8 grams of trigonal selenium, and 100 grams of stainless steel shot, $\frac{3}{8}''$ in diameter. The above mixture was then placed on a ball mill for 72 to 96 hours. Subsequently, 5 grams of the resulting slurry were added to a solution of 0.18 grams of polyvinyl carbazole, and 0.15 grams of N,N'-diphenyl-N,N'-bis(3-methylphenyl)1,1'-biphenyl-4,4'-diamine, in 6.3 milliliters of tetrahydrofuran-toluene, volume ratio 1:1. This slurry was then placed on a shaker for 10 minutes. The resulting slurry was then coated on the above adhesive interface with a Bird applicator, wet thickness 0.5 mils. This layer was then dried at 130° C. for 6 minutes in a forced air oven, resulting in a dry thickness of 2.0 microns. The resulting layer contained 10 volume percent of trigonal selenium and 25 volume percent of the diamine, and 65 volume percent of polyvinyl carbazole.

The above photogenerator layer was overcoated with a charge transport layer which was prepared as follows:

A transport layer containing 50 percent by weight of Makrolon ®, a polycarbonate resin having a molecular weight ($M_w$) of from about 50,000 to about 100,000, commercially available from Larbensabricken Bayer A.G., was mixed with 50 percent by weight of N,N'-diphenyl-N,N'-bis(3-methylphenyl)1,1'-biphenyl-4,4'-diamine. The resulting solution was then mixed in 15 percent by weight of methylene chloride. All of the above components were then placed into an amber bottle and dissolved. The mixture was coated to a dry 25 micron thickness layer on top of the photogenerator layer using a Bird applicator. During this coating process the humidity was equal to or less than 15 percent. The resulting device containing all of the above layers was annealed at 135° C. in a forced air oven for 6 minutes.

EXAMPLE IV

A photoreceptive device was prepared by providing an aluminized Mylar substrate in a thickness of 3 mils, and applying thereto in a wet thickness of 0.5 mils, a layer of 0.5 weight percent of duPont 49,000 adhesive, a polyester available from E. I. duPont, in methylene chloride and 1,1,2-trichloroethane (4:1 volume ratio) with a Bird applicator. This layer was then allowed to dry for one minute at room temperature and 10 minutes at 100° C. in a forced air oven. The resulting layer had a dry thickness of 0.05 microns.

There was then overcoated on the above adhesive layer, a photogenerating layer containing 30 volume percent of a trigonal selenium, 25 volume percent N,N'-diphenyl-N,N'-bis(3-methylphenyl)1,1'-biphenyl-4,4'-diamine and 45 volume percent of polyvinyl carbazole prepared as follows:

In a 2 oz. amber bottle was added 0.8 grams polyvinyl carbazole, and 18 milliliters, 1:1 by volume, tetrahydrofuran/toluene. Added to this solution was 2.1 grams of trigonal selenium, and 100 grams of stainless steel shot, $\frac{1}{8}''$ in diameter. The above mixture was then placed on a ball mill for 72 to 96 hours, resulting in a slurry. In a 1 oz. amber bottle was added 0.04 grams N,N'-diphenyl-N,N'-bis(3-methylphenyl)1,1'-biphenyl-4,4'-diamine, and 6.4 milliliters of tetrahydrofuran/toluene. Added to this solution was 2 grams of the ball milled slurry. The resulting mixture was then placed on a shaker for 10 minutes, and the slurry formed was then coated on the above 49,000 adhesive layer with a Bird applicator, at a wet thickness 0.5 mils. This device was then dried at 135° C. for 6 minutes in a forced air oven. The dry thickness of the photogenerating generator layer was 0.5 microns.

The above photogenerator layer was then overcoated with a charge transport layer which was prepared as follows:

A transport layer containing 50 percent by weight Makrolon ®, a polycarbonate resin having a molecular weight ($M_w$) of from about 50,000 to about 100,000 available from Larbensabricken Bayer A. G., was mixed with 50 percent by weight of N,N'-diphenyl-N,N'-bis(3-methylphenyl)1,1'-biphenyl-4,4'-diamine. The resulting was then mixed in 15 percent by weight methylene chloride. All of the above components were then placed into an amber bottle and dissolved. The mixture was then coated to a dry 25 micron thickness layer on top of the photogenerator layer using a Bird applicator. During this coating process, the humidity was equal to or less than 15 percent.

The resulting device containing all of the above layers was annealed at 135° C. in a forced air oven for 6 minutes.

EXAMPLE V

A photoreceptive device was prepared by providing an aluminized Mylar substrate in a thickness of 3 mils, and applying thereto in a wet thickness of 0.5 mils, a layer of 0.5 percent by weight of duPont 49,000 adhesive, a polyester available from duPont, in methylene chloride and 1,1,2-trichloroethane (4:1 volume ratio) with a Bird applicator. The wet thickness was 0.5 mil. This layer was then allowed to dry for one minute at room temperature and 10 minutes at 100° C. in a forced air oven. The resulting layer had a dry thickness of about 0.05 microns.

A photogenerator layer containing 33 percent by volume of trigonal selenium, and 13 percent by volume of N,N'-diphenyl-N,N'-bis(3-methylphenyl)1,1'-biphenyl-4,4'-diamine dispersed in 54 percent of the phenoxy resinous binder available from Union Carbide as Bakelite PHKK was prepared as follows:

In a 4 oz. amber bottle was added 1.6 grams of the above phenoxy resin and 0.4 grams N,N'-diphenyl-N,N'-bis(3-methylphenyl)1,1'-biphenyl-4,4'-diamine, in 21 milliliters of methyl ethyl ketone and 7 milliliters methoxyethyl acetate (cellosolve acetate). Added to this solution was 3.2 grams of trigonal selenium, and 200 grams of stainless steel shot, $\frac{1}{8}''$ in diameter. The above mixture was then placed on a ball mill for 72 to 96 hours. The slurry was then coated on the above duPont 49,000 adhesive layer with a Bird applicator, in a wet thickness 0.5 mils. This device was then dried at 135° C. for 6 minutes in a forced air oven. The dry thickness of the photogenerating generator layer was 0.5 microns.

The above photogenerator layer was then overcoated with a charge transport layer which was prepared as follows:

A transport layer containing 50 percent by weight Makrolon ®, a polycarbonate resin having a molecular weight ($M_w$) of from about 50,000 to about 100,000 available from Larbensabricken Bayer A. G., was mixed with 50 percent by weight N,N'-diphenyl-N,N'-bis(3-methylphenyl)1,1'-biphenyl-4,4'-diamine. The resulting solution was then mixed in 15 percent by weight of methylene chloride. All of the above components were then placed into an amber bottle and dissolved. The mixture was coated to a dry 25 micron thickness layer on top of the generator layer using a Bird applicator. During the coating process the humidity was equal to or less than 15 percent.

The resulting device containing all of the above layers was annealed at 135° C. in a forced air oven for 6 minutes.

EXAMPLE VI

A photoreceptive device was prepared by providing an aluminized Mylar substrate in a thickness of 3 mils, and applying thereto a layer of 0.5 percent by weight of duPont 49,000 adhesive, in methylene chloride and 1,1,2-trichloroethane 4:1 volume with a Bird Applicator. The layer was allowed to dry for one minute at room temperature, and 10 minutes at 100° C. in a forced air oven. The dry thickness of the resulting layer was 0.05 microns.

A photoconductive layer containing 30 percent by volume of vanadyl phthalocyanine was then prepared as follows:

In a 2 oz. amber bottle was added 0.76 grams of duPont 49,000 polyester in 16 milliliters methylene chloride. Added to this solution was 0.36 grams of vanadyl phthalocyanine, and 100 grams ⅛" stainless steel shot. The above mixture was placed on a ball mill for 24 hours. To 5 grams of this slurry was added 10 milliliters of methylene chloride. This slurry is coated on the above polyester adhesive layer with a Bird applicator, to a wet thickness of 0.5 mils. This layer was allowed to air dry for 5 minutes. This device was dried at 135° C. for 6 minutes in a forced air oven. The dry thickness was 0.5 microns.

The above photoconductive layer was then overcoated with a charge transport layer which was prepared as follows:

A transport layer containing 50 percent by weight Makrolon ®, a polycarbonate resin having a molecular weight ($M_w$) of from about 50,000 to about 100,000 available from Larbensabriken Bayer A.G., was mixed with 50 percent by weight N,N'-diphenyl-N,N'-bis(3-methylphenyl)1,1'-biphenyl-4,4'-diamine. This solution was then mixed in 15 percent by weight of methylene chloride. All of these components were placed into an amber bottle and dissolved. The mixture was coated to a dry 25 micron thickness layer on top of the generator layers using a Bird applicator. During this coating process humidity was equal to or less than 15 percent.

The resulting device containing all of the above layers was annealed at 135° C. in a forced air oven for 6 minutes.

EXAMPLE VII

A photoreceptive device was prepared by providing an aluminized Mylar substrate in a thickness of 3 mils, and applying thereto in a wet thickness of 0.5 mils, a layer of 0.5 percent weight of duPont 49,000 polyester adhesive, in methylene chloride and 1,1,2-trichloroethane (4:1 volume ratio) with a Bird Applicator. The layer was allowed to dry for one minute at room temperature, and 10 minutes at 100° C. in a forced air oven. The resulting layer had a dry thickness of 0.5 microns.

A photoconductive layer containing 30 percent by volume of hydroxy squarylium was then prepared as follows:

In a 2 oz. amber bottle was added 0.76 grams Formuar 12.85, commercially available from Monsanto Chemical Company and 16 milliliters of tetrahydrofuran. Added to this solution was 0.36 grams of hydroxy squarylium, and 100 grams ⅛" stainless steel shot. The above mixture was placed on a ball mill for 24 hours. To 5 grams of this slurry was added 10 milliliters of tetrahydrofuran. This slurry was then coated on the above adhesive layer with a Bird applicator, to a wet thickness of 0.5 mils. The resulting layer was allowed to air dry for 5 minutes. This device was dried at 135° C. for 6 minutes in a forced air oven. The dry thickness of the photoconductive layer was 0.5 microns.

The above photoconductive layer was overcoated with a charge transport layer which was prepared as follows:

A transport layer containing 50 percent by weight Makrolon ®, a polycarbonate resin having a molecular weight ($M_w$) of from about 50,000 to about 100,000 available from Larbensabricken Bayer A.G., was mixed with 50 percent by weight N,N'-diphenyl-N,N'-bis(3-methylphenyl)1,1'-biphenyl-4,4'-diamine. This solution was mixed in 15 percent by weight of methylene chloride. All of these components were placed into an amber bottle and dissolved. The mixture was coated to a dry 25 micron thickness layer on top of the generator layers using a Bird applicator. During this coating process humidity was equal to or less than 15 percent.

The resulting device containing all of the above layers was annealed at 135° C. in a forced air oven for 6 minutes.

EXAMPLE VIII

A photoreceptive device was prepared by providing an aluminized Mylar substrate in a thickness of 3 mils and applying thereto in a wet thickness of 0.5 mils, a layer of 0.5 percent weight of duPont 49,000 adhesive, in methylene chloride and 1,1,2-trichloroethane 4:1 volume with a Bird Applicator. The layer was allowed to dry for one minute at room temperature and 10 minutes at 100° C. in a forced air oven. The resulting layer had a dry thickness of 0.05 microns.

A photogenerator layer containing 10 volume percent of trigonal selenium, 25 percent by volume N,N'-diphenyl-N,N'-bis(3-methylphenyl)1,1'-biphenyl-4,4'-diamine and 65 volume percent of polyvinyl carbazole was then prepared as follows:

In a 2 oz. amber bottle was added 0.8 grams polyvinyl carbazole and 14 milliliters 1:1 by volume tetrahydrofuran/toluene. Added to this solution was 0.8 grams of trigonal selenium and 100 grams of ⅛" stainless steel shot. The above mixture was placed on a ball mill for 72–96 hours. Five grams of this slurry was added to a solution of 0.18 grams of polyvinyl carbazole and 0.15 grams N,N'-bis(3-methylphenyl)1,1'-biphenyl-4,4'-diamine in 6.3 milliliters of tetrahydrofuran/toluene. This mixture was placed on a shaker for 10 minutes. The slurry was then coated on the above adhesive interface with a Bird applicator. The wet thickness was 0.5 mils. This layer was dried at 135° C. for 6 minutes in a forced air oven. The dry thickness was 2.0 microns.

A photoconductive layer containing 30 percent by volume vanadyl phthalocyanine was then prepared as follows:

In a 2 oz. amber bottle was added 0.76 grams of duPont 49,000 in 16 milliliters methylene chloride. Added to this solution was 0.36 grams of vanadyl phthalocyanine and 100 grams ⅛" stainless steel shot. The above mixture was placed on a ball mill for 24 hours. To 5 grams of this slurry was added 10 milliliters of methylene chloride. This slurry was then coated on the above photogenerator layer with a Bird applicator to a wet thickness of 0.5 mil. This layer was allowed to air dry 1–5 minutes to a dry thickness of 0.5 microns. The resulting device was dried at 135° C. for 6 minutes in a forced air oven.

The above photoconductive layer was overcoated with a charge transport layer which was prepared as follows:

A transport layer containing 50 percent by weight Makrolon ®, a polycarbonate resin having a molecular weight ($M_w$) of from about 50,000 to about 100,000 available from Larbensabricken Bayer A. G., was mixed with 50 percent by weight N,N'-diphenyl-N,N'-bis(3-methylphenyl)1,1'-biphenyl-4,4'-diamine. This solution was mixed in 15 percent by weight of methylene chloride. All of these components were placed into an amber bottle and dissolved. The mixture was coated to a dry 25 micron thickness layer on top of the generator layers using a Bird applicator. During this coating process the humidity was equal to or less than 15 percent.

The resulting device containing all of the above layers was then annealed at 135° C. in a forced air oven for 6 minutes.

EXAMPLE IX

A photoreceptive device was prepared by providing an aluminized Mylar substrate in a thickness of 3 mils, and applying thereto in a wet thickness of 0.5 mils a layer of 0.5 percent weight of duPont 49,000 polyester adhesive, in methylene chloride and 1,1,2-trichloroethane (4:1 volume ratio) with a Bird Applicator. The layer was allowed to dry for one minute at room temperature, and 10 minutes at 100° C. in a forced air oven.

A photogenerator layer containing 30 percent by volume of trigonal selenium and 25 percent by volume of N,N'-diphenyl-N,N'-bis(3-methylphenyl)1,1'-biphenyl-4,4'-diamine was then prepared as follows:

In a 2 oz. amber bottle was added 0.8 grams polyvinyl carbazole, and 18 milliliters, 1:1 by volume, tetrahydrofuran/toluene. Added to this solution was 2.1 grams of trigonal selenium, and 100 grams of stainless steel shot, ⅛" in diameter. The above mixture was then placed on a ball mill for 72 to 96 hours. In a 1 oz. amber bottle was added 0.04 grams of N,N'-diphenyl-N,N'-bis(3-methylphenyl)1,1'-biphenyl-4,4'-diamine, and 6.4 milliliters of tetrahydrofuran/toluene. Added to this solution was 2 grams of the ball milled slurry. The resulting mixture was placed on a shaker for 10 minutes, and the slurry formed was then coated on the above 49,000 adhesive layer with a Bird applicator, in a wet thickness 0.5 mils. This device was allowed to air dry for 5 minutes. The dry thickness of the resulting photogenerating generator layer was 0.5 microns. This layer was dried at 135° C. for 6 minutes.

A photoconductive layer containing 30 percent by volume of vanadyl phthalocyanine was then prepared as follows:

In a 2 oz. amber bottle was added 0.76 grams of duPont 49,000 polyester in 16 milliliters of methylene chloride. Added to this solution was 0.36 grams of vanadyl phthalocyanine, and 100 grams of ⅛" stainless steel shot. The above mixture was the placed on a ball mill for 24 hours. To 5 grams of the resulting slurry there was added 10 milliliters of methylene chloride. The slurry was then coated on the above photogenerating layer with a Bird applicator, to a wet thickness of 0.5 mils. The layer was then allowed to air dry for 5 minutes to a dry thickness of 0.5 microns. The resulting layer was then dried at 135° C. for 6 minutes in a forced air oven.

The above photoconductive layer was overcoated with a charge transport layer which was prepared as follows:

A transport layer containing 50 percent by weight Makrolon ®, a polycarbonate resin having a molecular weight ($M_w$) of from about 50,000 to about 100,000 available from Larbensabricken Bayer A.G., was mixed with 50 percent by weight N,N'-diphenyl-N,N'-bis(3-methylphenyl)1,1'-biphenyl-4,4'-diamine. This solution was mixed in 15 percent by weight of methylene chloride. All of these components were then placed into an amber bottle and dissolved. The mixture was coated to a dry 25 micron thickness layer on top of the generator layers using a Bird applicator. During this coating process the humidity was equal to or less than 15 percent.

The resulting device containing all of the above layers was then annealed at 135° C. in a forced air oven for 6 minutes.

EXAMPLE X

A photoreceptive device was prepared by providing an aluminized Mylar substrate in a thickness of 3 mils and applying thereto in a wet thickness of 0.5 mils, a layer of 0.5 weight percent DuPont 49,000 adhesive, in methylene chloride and 1,1,2-trichlorethane (4:1 volume ratio) with a Bird Applicator. This layer was then allowed to dry for one minute at room temperature, and 10 minutes at 100° C. in a forced air oven. The resulting layer had a dry thickness of 0.05 microns.

A photogenerator layer was then prepared containing 33 percent by volume of trigonal selenium, and 13 percent by volume N,N'-diphenyl-N,N'-bis(3-methylphenyl)1,1'-biphenyl-4,4'-diamine dispersed in a phenoxy resinous binder 54, percent by volume, was prepared as follows:

In a 4 oz. amber bottle was added 1.6 grams of the phenoxy resin Bakelite, available from Union Carbide, 21 milliliters of methyl ethyl ketone, and 7 milliliters of methoxy ethyl acetate. Added to this solution was 3.2 grams of trigonal selenium, and 200 grams ⅛" stainless steel shot. The above mixture was placed on a ball mill for 72–96 hours. The slurry formed was then coated on the above interface with a Bird applicator, to a wet thickness of 0.5 mil and, the resulting layer was allowed to air dry for 5 minutes to a dry thickness of 0.5 microns. The layer was then dried at 135° C. for 6 minutes in a forced air oven.

A photoconductive layer containing 30 percent by volume of vanadyl phthalocyanine was then prepared as follows:

In a 2 oz. amber bottle was added 0.76 grams of duPont 49,000 polyester adhesive, and 16 ml of methylene chloride. Added to this solution was 0.36 grams of vanadyl phthalocyanine and 100 grams ⅛" stainless steel shot. The above mixture was placed on a ball mill for 24 hours. To 5 grams of this slurry was added 10 milliliters of methylene chloride. This slurry was coated on the above photogenerator layer with a Bird applicator to a wet thickness of 0.5 mils. This layer was allowd to air dry for 5 minutes. The device was dried at 135° C. for 6 minutes in a forced air oven, to a dry thickness of 0.5 microns.

The above photoconductive layer was overcoated with a charge transport layer which was prepared as follows:

A transport layer containing 50 percent by weight Makrolon ®, a polycarbonate resin having a molecular weight ($M_w$) of from about 50,000 to about 100,000 available from Larbensabricken Bayer A. G., was mixed with 50 percent by weight N,N'-diphenyl-N,N'-bis(3-methylphenyl)1,1'-biphenyl-4,4'-diamine. This solution was mixed in 15 percent by weight of methylene chloride. All of these components were placed into an amber bottle and dissolved. The mixture was coated to a dry 25 micron thickness layer on top of the generator layers using a Bird applicator. Humidity was equal to or less than 15 percent.

The resulting device containing all of the above layers was then annealed at 135° C. in a forced air oven for 6 minutes.

A photoresponsive device was prepared by repeating the above process with the exception that the photoconductive layer thickness was 1.0 microns.

EXAMPLE XI

A photoreceptive device was prepared by providing an aluminized Mylar substrate in a thickness of 3 mils and applying thereto a layer of 0.5 percent by weight duPont 49,000 adhesive, a polyester available from duPont, in methylene chloride, and 1,1,2-trichloroethane (4:1 volume ratio) with a Bird applicator, to a wet thickness of 0.5 mils. The layer was allowed to dry for one minute at room temperature, and 10 minutes at 100° C. in a forced air oven. The resulting layer had a dry thickness of about 0.05 microns.

A photogenerator layer containing 10 percent volume trigonal selenium, and 25 percent by volume of N,N'-diphenyl-N,N'-bis(3-methylphenyl)1,1'-bisphenyl-4,4'-diamine and 65 volume percent of polyvinyl carbazole was then prepared as follows:

In a 2 oz. amber bottle was added 0.8 grams polyvinyl carbazole and 14 milliliters; 1:1 volume ratio, tetrahydrofuran:toluene. There was then added to this solution 0.8 grams of trigonal selenium and 100 grams of stainless steel shot, ⅛" in diameter. The above mixture was then placed on a ball mill for 72 to 96 hours. Subsequently, 5 grams of the resulting slurry were added to a solution of 0.18 grams of polyvinyl carbazole, and 0.15 grams of N,N'-diphenyl-N,N'-bis(3-methylphenyl)1,1'-biphenyl-4,4'-diamine, in 6.3 milliliters of tetrahydrofuran-toluene, volume ratio 1:1. This slurry was then placed on a shaker for 10 minutes. The resulting slurry was then coated on the above interface with a Bird applicator, wet thickness 0.5 mils. This layer was then dried at 135° C. for 6 minutes in a forced air oven, resulting in a dry thickness of 2.0 microns.

A photoconductive layer containing 30 percent by volume hydroxy squarylium was then prepared as follows:

In a 2 oz. amber bottle was added 0.76 grams Formvar 12/85, commercially available from Monsanto and 16 milliliters tetrahydrofuran. Added to this solution was 0.36 grams of hydroxy squarylium and 100 grams ⅛" stainless steel shot. The above mixture was placed on a ball mill for 24 hours. To 5 grams of this slurry was added 10 milliliters of additional solvent. This slurry was then coated on the above photogenerator layer with a Bird applicator, to a wet thickness of 0.5 mils. The resulting device was dried at 135° C. for 6 minutes in a forced air oven. The dry thickness of the photoconductive layer was 0.5 microns.

The above photoconductive layer was overcoated with a charge transport layer which was then prepared as follows:

A transport layer containg 50 percent by weight Makrolon ®, a polycarbonate resin having a molecular weight ($M_w$) of from about 50,000 to about 100,000 available from Larbensabricken Bayer A. G., was mixed with 50 percent by weight N,N'-diphenyl-N,N'-bis(3-methylphenyl)1,1'-biphenyl-4,4'-diamine. The resulting solution was mixed in 15 percent by weight of methylene chloride. All of these components were placed into an amber bottle and dissolved. The mixture was coated to a dry 25 micron thickness layer on top of the generator layers using a Bird applicator. During this coating process the humidity was equal to or less than 15 percent.

The resulting device containing all of the above layers was annealed at 135° C. in a forced air oven for 6 minutes.

EXAMPLE XII

A photoreceptive device was prepared by providing an aluminized Mylar substrate in a thickness of 3 mils, and applying thereto in a wet thickness of 0.5 mils, a layer of 0.5 percent by weight of duPont 49,000 adhesive, a polyester available from duPont, in methylene chloride and 1,1,2-trichloroethane (4:1 volume ratio) with a Bird applicator. The wet thickness was 0.5 mil. This layer was then allowed to dry for one minute at room temperature and 10 minutes at 100° C. in a forced air oven. The resulting layer had a dry thickness of about 0.05 microns.

A photogenerator layer containing 30 percent by volume of trigonal selenium, 25 percent by volume of N,N'-diphenyl-N,N'-bis(3-methylphenyl)1,1'-biphenyl-4,4'-diamine and 45 volume percent of polyvinyl carbazole was prepared as follows:

In a 2 oz. amber bottle was added 0.8 grams polyvinyl carbazole and 18 milliliters, 1:1 volume ratio, tetrahydrofuran:toluene. There was then added to this solution 2.1 grams of trigonal selenium and 100 grams of stainless steel shot, ⅛" in diameter. The above mixture was then placed on a ball mill for 72 to 96 hours. In a 1 oz. amber bottle was added 0.04 grams N'-diphenyl-N,N'-bis(3-methylphenyl)1,1'-biphenyl-4,4'-diamine and 6.4 milliliters of tetrahydrofuran-toluene, volume ratio 1:1. Added to this solution was 2 grams of the ball milled slurry. This slurry was then placed on a shaker for 10 minutes. The resulting slurry was then coated on the above 49,000 adhesive layer with a Bird applicator, to a wet thickness 0.5 mils. This device was then allowed to air dry 1 to 5 minutes to a a dry thickness for the photogenerator layer of 0.5 microns. The resulting device was then dried at 135° C. for 6 minutes in a forced air oven.

A photoconductive layer containing 30 percent by volume of hydroxy squarylium was prepared as follows:

In a 2 oz. amber bottle was added 0.76 grams Formvar 12/85, and 16 milliliters tetrahydrofuran. Added to this solution was 0.36 grams of hydroxy squarylium and 100 grams ⅛" stainless steel shot. The above mixture was placed on a ball mill for 24 hours. To 5 grams of this slurry was added 10 milliliters of additional solvent. This slurry was then coated on the above generator layer with a Bird applicator, to a wet thickness of 0.5 mils. The resulting device was dried at 135° C. for 6 minutes in a forced air oven. The dry thickness of the photoconductive layer was 0.5 microns.

The above photoconductive layer was overcoated with a charge transport layer which was then prepared as follows:

A transport layer containg 50 percent by weight Makrolon ®, a polycarbonate resin having a molecular weight ($M_w$) of from about 50,000 to about 100,000 available from Larbensabricken Bayer A. G., was mixed with 50 percent by weight N,N'-diphenyl-N,N'-bis(3-methylphenyl)1,1'-biphenyl-4,4'-diamine. The resulting solution was mixed in 15 percent by weight of methylene chloride. All of these components were then placed into an amber bottle and dissolved. The mixture was coated to a dry 25 micron thickness layer on top of the generator layers using a Bird applicator. During this coating process the humidity was equal to or less than 15 percent.

The resulting device containing all of the above layers was annealed at 135° C. in a forced air oven for 6 minutes.

EXAMPLE XIII

A photoreceptive device was prepared by providing an aluminized Mylar substrate in a thickness of 3 mils, and applying thereto in a wet thickness of 0.5 mils, a layer of 0.5 percent by weight of duPont 49,000 adhesive, a polyester available from duPont, in methylene chloride and 1,1,2-trichloroethane (4:1 volume ratio) with a Bird applicator. The wet thickness was 0.5 mil. This layer was then allowed to dry for one minute at room temperature and 10 minutes at 100° C. in a forced air oven. The resulting layer had a dry thickness of about 0.05 microns.

A photogenerator layer containing 33 percent by volume of trigonal selenium, and 13 percent by volume of N,N'-diphenyl-N,N'-bis(3-methylphenyl)1,1'-biphenyl-4,4'-diamine in the phenoxy binder Bakelite available from Union Carbide was prepared as follows:

In a 4 oz. amber bottle was added 1.6 grams of the above phenoxy resin, 21 milliliters methyl ethyl ketone and 7 milliliters methoxy ethyl acetate. Added to this solution was 3.2 grams of trigonal selenium, and 200 grams $\frac{1}{8}$" stainless steel shot. The above mixture was placed on a ball mill for 72–96 hours. This slurry was then coated on the above polyester with a Bird applicator, to a wet thickness of 0.5 mils. This layer was allowed to air dry 2–5 minutes. The dry thickness was 0.5 microns. This layer was then dried at 135° C. in forced air for 6 minutes.

A photoconductive layer containing 30 percent by volume of hydroxy squarylium, was then prepared as follows:

In a 2 oz. amber bottle was added 0.76 grams Monsanto Formvar 12/85, and 16 ml. of tetrahydrofuran. Added to this solution was 0.36 grams of hydroxy squarylium and 100 grams $\frac{1}{8}$" stainless steel shot. The above mixture was placed on a ball mill for 24 hours. To 5 grams of this slurry was added 10 milliliters of additional solvent. This slurry was then coated on the above photogenerator with a Bird applicator, to a wet thickness of 0.5 mils. The resulting device was dried at 135° C. for 6 minutes in a forced air oven. The dry thickness of the photoconductive layer was 0.5 microns.

The above photoconductive layer was overcoated with a charge transport layer which was then prepared as follows:

A transport layer containing 50 percent by weight Makrolon ®, a polycarbonate resin having a molecular weight ($M_w$) of from about 50,000 to about 100,000 available from Larbensabricken Bayer A. G., was mixed with 50 percent by weight N,N'-diphenyl-N,N'-bis(3-methylphenyl)1,1'-biphenyl-4,4'-diamine. This solution was mixed in 15 percent by weight of methylene chloride. All of these components were placed into an amber bottle and dissolved. The mixture was coated to a dry 25 micron thickness layer on top of the generator layers using a Bird applicator. During this coating process the humidity was equal to or less than 15 percent.

The resulting device containing all of the above layers was annealed at 135° C. in a forced air oven for 6 minutes.

EXAMPLE XIV

A photoreceptive device was prepared by providing an aluminized Mylar substrate in a thickness of 3 mils, and applying thereto in a wet thickness of 0.5 mils, a layer of 0.5 weight percent of duPont 49,000 adhesive, in methylene chloride and 1,1,2-trichloroethane (4:1 volume ratio) with a Bird applicator. This layer was then allowed to dry for one minute at room temperature and 10 minutes at 100° C. in a forced air oven. The resulting layer had a dry thickness of 0.05 microns.

There was then overcoated on the above adhesive layer by known vacuum evaporation processes, a layer of arsenic triselenide, 0.5 microns in thickness.

A photoconductive layer containing 30 percent by volume vanadyl phthalocyanine was then prepared as follows:

In a 2 oz. amber bottle was added 0.76 grams of duPont 49,000 polyester in 16 milliliters methylene chloride. Added to this solution was 0.36 grams of vanadyl phthalocyanine, and 100 grams $\frac{1}{8}$" stainless steel shot. The above mixture was placed on a ball mill for 24 hours. To 5 grams of this slurry was added 10 milliliters of methylene chloride. This slurry was coated on the above photogenerator layer with a Bird applicator, to a wet thickness of 0.5 mils. The resulting layer was allowed to air dry for 5 minutes. This device was dried at 135° C. for 6 minutes in aa forced air oven. The dry thickness of the photoconductive layer was 0.5 microns.

The above photoconductive layer was overcoated with a charge transport layer which was then prepared as follows:

A transport layer containing 50 percent by weight Makrolon ®, a polycarbonate resin having a molecular weight ($M_w$) of from about 50,000 to about 100,000 available from Larbensabricken Bayer A. G., was mixed with 50 percent by weight N,N'-diphenyl-N,N'-bis(3-methylphenyl)1,1'-biphenyl-4,4'-diamine. The resulting solution was mixed in 15 percent by weight of methylene chloride. All of these components were then placed into an amber bottle and dissolved. The mixture was coated to a dry 25 micron thickness layer on top of the generator layers using a Bird applicator. During this coating process the humidity was equal to or less than 15 percent.

The resulting device was annealed at 135° C. in a forced air oven for 6 minutes.

EXAMPLE XV

A photoreceptive device was prepared by providing an aluminized Mylar substrate in a thickness of 3 mils, and applying thereto in a wet thickness of 0.5 mils, a layer of 0.5 percent weight of duPont 49,000 polyester adhesive, in methylene chloride and 1,1,2-trichloroethane (4:1 volume ratio) with a Bird Applicator. The layer was allowed to dry for one minute at room temperature and 10 minutes at 100° C. in a forced air oven. The resulting layer had a dry thickness was 0.5 microns.

There was then overcoated on the adhesive layer 49,000 by known vacuum evaporation processes, a layer of arsenic triselenide, 0.5 microns in thickness.

A photoconductive layer containing 30 percent by volume of hydroxy squarylium was then prepared as follows:

In a 2 oz. amber bottle was added 0.76 grams Formvar 12/85, and 16 milliliters of tetrahydrofuran. Added to this solution was 0.36 grams of hydroxy squarylium, and 100 grams ⅛" stainless steel shot. The above mixture was placed on a ball mill for 24 hours. To 5 grams of this slurry was added 10 milliliters of additional tetrahydrofuran. The resulting slurry was then coated on the above photogenerator layer with a Bird applicator, to a wet thickness of 0.5 mils. The resulting layer was allowed to air dry for 5 minutes. This device was dried at 135° C. for 6 minutes in a forced air oven. The dry thickness of the photoconductive layer was 0.5 microns.

The above photoconductive layer was overcoated with a charge transport layer which was prepared as follows:

A transport layer containing 50 percent by weight Makrolon ®, a polycarbonate resin having a molecular weight ($M_w$) of from about 50,000 to about 100,000 available from Larbensabricken Bayer A. G., was mixed with 50 percent by weight N,N'-diphenyl-N,N'-bis(3-methylphenyl)1,1'-biphenyl-4,4'-diamine. This solution was mixed in 15 percent by weight of methylene chloride. All of these components were placed into an amber bottle and dissolved. The mixture was coated to a dry 25 micron thickness layer on top of the generator layers using a Bird applicator. During this coating process the humidity was equal to or less than 15 percent.

The resulting device containing all of the above layers was annealed at 135° C. in a forced air oven for 6 minutes.

EXAMPLE XVI

A photoreceptive device was prepared by providing an aluminized Mylar substrate in a thickness of 3 mils and applying thereto in a wet thickness of 0.5 mils, a layer of 0.5 percent weight of duPont 49,000 adhesive, in methylene chloride and 1,1,2-trichloroethane 4:1 volume with a Bird Applicator. The layer was allowed to dry for one minute at room temperature and 10 minutes at 100° C. in a forced air oven. The resulting layer had a dry thickness of 0.05 microns.

A photoconductive layer containing 30 percent by volume of vanadyl phthalocyanine was then prepared as follows:

In a 2 oz. amber bottle was added 0.76 grams of duPont 49,000 polyester in 16 milliliters methylene chloride. Added to this solution was 0.36 grams of vanadyl phthalocyanine, and 100 grams ⅛" stainless steel shot. The above mixture was placed on a ball mill for 24 hours. To 5 grams of this slurry was added 10 milliliters of methylene chloride. This slurry was coated on the above polyester with a Bird applicator, to a wet thickness of 0.5 mils. This layer was allowed to air dry for 5 minutes. The resulting device was dried at 135° C. for 6 minutes in a forced air oven. The dry thickness of the photoconductive layer was 0.5 microns.

A photogenerator layer containing 10 volume percent of trigonal selenium, 25 percent by volume N,N'-diphenyl-N,N'-bis(3-methylphenyl)1,1'-biphenyl-4,4'-diamine and 55 volume percent of polyvinyl carbazole was then prepared as follows:

In a 2 oz. amber bottle was added 0.8 grams polyvinyl carbazole and 14 milliliters 1:1 by volume tetrahydrofuran/toluene. Added to this solution was 0.8 grams of trigonal selenium and 100 grams of ⅛" stainless steel shot. The above mixture was placed on a ball mill for 72–96 hours. Five grams of this slurry was added to a solution of 0.18 grams of polyvinyl carbazole and 0.15 grams N,N'-bis(3-methylphenyl)1,1'-biphenyl-4,4'-diamine in 6.3 milliliters of tetrahydrofuran/toluene. The resulting solution was placed on a shaker for 10 minutes. The slurry formed was then coated on the above photoconductive layer with a Bird applicator, in a wet thickness of 0.5 mils. The resulting device layer was dried at 135° C. for 6 minutes in a forced air oven. The dry thickness of the photoconductive layer was 2.0 microns.

The photogenerating layer was then overcoated with a charge transport layer which was prepared as follows:

A transport layer containing 50 percent by weight Makrolon ®, a polycarbonate resin having a molecular weight ($M_w$) of from about 50,000 to about 100,000 available from Larbensabricken Bayer A. G., was mixed with 50 percent by weight of N,N'-diphenyl-N,N'-bis(3-methylphenyl)1,1'-biphenyl-4,4'-diamine. This solution was mixed in 15 percent by weight of methylene chloride. All of these components were placed into an amber bottle and dissolved. The mixture was coated to a dry 25 micron thickness layer on top of the generator layers using a Bird applicator. During this coating process the humidity was equal to or less than 15 percent.

The resulting device containing all of the above layers was then annealed at 135° C. in a forced air oven for 6 minutes.

EXAMPLE XVII

A photoreceptive device was prepared by providing an aluminized Mylar substrate in a thickness of 3 mils, and applying thereto in a wet thickness of 0.5 mils a layer of 0.5 percent weight of duPont 49,000 polyester adhesive, in methylene chloride and 1,1,2-trichloroethane (4:1 volume ratio) with a Bird Applicator. The layer was allowed to dry for one minute at room temperature, and 10 minutes at 100° C. in a forced air oven. The dry thickness was about 0.05 microns.

A photoconductive layer containing 30 percent by volume of vanadyl phthalocyanine was then prepared as follows:

In a 2 oz. amber bottle was added 0.76 grams of duPont 49,000, and 16-ml of methylene chloride. Added to this solution was 0.36 grams of vanadyl phthalocyanine and 100 grams ⅛" stainless steel shot. The above mixture was placed on a ball mill for 24 hours. To 5 grams of the slurry was added 10 milliliters of methylene chloride. This slurry was coated on the above adhesive interface with a Bird applicator to a wet thickness of 0.5 mils. This layer was allowed to air dry for 5 minutes. The resulting device was dried at 135° C. for 6 minutes in a forced air oven. The dry thickness of the photoconductive layer was 0.5 microns.

A photogenerator layer containing 33 percent by volume of trigonal selenium and 13 percent by volume of N,N'-diphenyl-N,N'-bis(3-methylphenyl)1,1'-biphenyl-4,4'-diamine in a phenoxy resinous binder 54 percent by volume, was then prepared as follows:

In a 4 oz. amber bottle was added 1.6 grams of the above phenoxy resin, 21 milliliters methyl ethyl ketone and 7 milliliters methoxy ethyl acetate. Added to this solution was 3.2 grams trigonal selenium, and 200 grams ⅛" stainless steel shot. The above mixture was placed on a ball mill for 79–96 hours. This slurry was then coated on the above photoconductive layer with a Bird applicator, to a wet thickness of 0.5 mils. The resulting device was allowed to air dry 2.5 minutes. The dry thickness of the photoconductive layer was 0.5 microns. The device layer was then dried at 135° C. in forced air for 6 minutes.

The above photoconductive layer was overcoated with a charge transport layer which was then prepared as follows:

A transport layer containing 50 percent by weight Makrolon ®, a polycarbonate resin having a molecular weight ($M_w$) of from about 50,000 to about 100,000 available from Larbensabricken Bayer A. G., was mixed with 50 percent by weight N,N'-diphenyl-N,N'-bis(3-methylphenyl)1,1'-biphenyl-4,4'-diamine. This solution was mixed in 15 percent by weight methylene chloride. All of these components were placed into an amber bottle and dissolved. The mixture was coated to a dry 25 micron thickness layer on top of the generator layers using a Bird applicator. During this coating process the humidity was equal to or less than 15 percent.

The resulting device containing all of the above layers was annealed at 135° C. in a forced air oven for 6 minutes.

EXAMPLE XVIII

A photoreceptive device was prepared by providing an aluminized Mylar substrate in a thickness of 3 mils, and applying thereto in a wet thickness of 0.5 mils, a layer of 0.5 percent by weight of duPont 49,000 adhesive, a polyester available from duPont, in methylene chloride and 1,1,2-trichloroethane (4:1 volume ratio) with a Bird applicator. The wet thickness was 0.5 mil. This layer was then allowed to dry for one minute at room temperature and 10 minutes at 100° C. in a forced air oven. The resulting layer had a dry thickness of about 0.05 microns.

A photoconductive layer containing 30 percent by volume of hydroxy squarylium was prepared as follows:

In a 2 oz. amber bottle is added 0.76 grams Formvar 12/85, (Monsanto) and 16 milliliters tetrahydrofuran. Added to this solution was 0.36 grams of hydroxy squarylium and 100 grams ⅛" stainless steel shot. The above mixture was placed on a ball mill for 24 hours. To 5 grams of this slurry was added 10 milliliters of additional solvent. This slurry was then coated on the above adhesive interface with a Bird applicator, to a wet thickness of 0.5 mils. The resulting device was dried at 135° C. for 6 minutes in a forced air oven. The dry thickness of the photoconductive layer was 0.5 microns.

A generator layer containing 10 percent by volume of trigonal selenium, and 25 percent by volume of N,N'-diphenyl-N,N'-bis(3-methylphenyl)1,1'-biphenyl-4,4'-diamine and 65 volume percent of polyvinyl carbazole was prepared as follows:

In a 2 oz. amber bottle was added 0.8 grams polyvinyl carbazole and 14-milliliters 1:1 volume ratio, tetrahydrofuran:toluene. There was then added to this solution 0.8 grams of trigonal selenium and 100 grams of stainless steel shot, ⅛" in diameter. The above mixture was then placed on a ball mill for 72 to 96 hours. In a 1 oz. amber bottle was added 0.15 grams N'-diphenyl-N,N'-bis(3-methylphenyl)1,1'-biphenyl-4,4'-diamine. 0.18 grams polyvinylcarbazole, and 6.3 milliliters of tetrahydrofuran-toluene, volume ratio 1:1. Added to this solution was 5 grams of the ball milled slurry. The slurry formed was then placed on a shaker for 10 minutes. The resulting slurry was then coated on the above photoconductive layer with a Bird applicator, to a wet thickness 0.5 mils. This layer was then dried at 135° C. for 6 minutes in a forced air oven, resulting in a dry thickness for the generator layer of 2.0 microns.

The above photoconductive layer was overcoated with a charge transport layer which was then prepared as follows:

A transport layer containing 50 percent by weight Makrolon ®, a polycarbonate resin having a molecular weight ($M_w$) of from about 50,000 to about 100,000 available from Larbensabricken Bayer, A. G., was mixed with 50 percent by weight N,N'-diphenyl-N,N'-bis(3-methylphenyl)1,1'-biphenyl-4,4'-diamine. This solution was mixed in 15 percent by weight of methylene chloride. All of these components were placed into an amber bottle and dissolved. The mixture was coated to a dry 25 micron thickness layer on top of the generator layers using a Bird applicator. During this coating process the humidity was equal to or less than 15 percent.

The resulting device containing all of the above layers was annealed at 135° C. in a forced air oven for 6 minutes.

EXAMPLE XIX

A photoreceptive device was prepared by providing an aluminized Mylar substrate in a thickness of 3 mils, and applying thereto in a wet thickness of 0.5 mils, a layer of 0.5 percent by weight of duPont 49,000 adhesive, a polyester available from duPont, in methylene chloride and 1,1,2-trichloroethane (4:1 volume ratio) with a Bird applicator. The wet thickness was 0.5 mil. This layer was then allowed to dry for one minute at room temperature and 10 minutes at 100° C. in a forced air oven. The resulting layer had a dry thickness of about 0.05 microns.

A photoconductive layer containing 30 percent by volume of hydroxy squarylium was prepared as follows:

In a 2 oz. amber bottle was added 0.76 grams Monsanto Formvar 12/85 and 16 ml tetrahydrofuran. Added to this solution was 0.36 grams of hydroxy squarylium and 100 grams ⅛" stainless steel shot. The above mixture was placed on a ball mill for 24 hours. To 5 grams of this slurry was added 10 milliliters of additional solvent. The slurry formed was then coated on the above adhesive layer with a Bird applicator, to a wet thickness of 0.5 mils. The resulting device was dried at 135° C. for 6 minutes in a forced air oven. The dry thickness of the photoconductive layer was 0.5 microns.

A photoconductive layer containing 33 percent by volume of trigonal selenium, and 13 percent by volume of N,N'-diphenyl-N,N'-bis(3-methylphenyl)1,1'-biphenyl-4,4'-diamine in a Bakelite phenoxy binder was prepared as follows:

In a 4 oz. amber bottle was added 1.6 grams of the above phenoxy resin, 21 milliliters methyl ethyl ketone and 7 milliliters methoxy ethyl acetate. Added to this solution was 3.2 grams trigonal selenium, and 200 grams $\frac{1}{8}''$ stainless steel shot. The above mixture was placed on a ball mill for 72–96 hours. The resulting slurry was then coated on the above photoconductive layer with a Bird applicator, to a wet thickness of 0.5 mils. The resulting device was allowed to air dry 2.5 minutes, followed by drying at 135° C. in forced air for 6 minutes. The dry thickness of the photoconductive layer was 0.5 microns.

The above photoconductive layer was overcoated with a charge transport layer which was then prepared as follows:

A transport layer containing 50 percent by weight Makrolon ®, a polycarbonate resin having a molecular weight ($M_w$) of from about 50,000 to about 100,000 available from Larbensabricken Bayer A. G., was mixed with 50 percent by weight N,N'-diphenyl-N,N'-bis(3-methylphenyl)1,1'-biphenyl-4,4'-diamine. This solution was mixed in 15 percent by weight of methylene chloride. All of these components were placed into an amber bottle and dissolved. The mixture was coated to a dry 25 micron thickness layer on top of the generator layers using a Bird applicator. During this coating process the humidity was equal to or less than 15 percent.

The resulting device containing all of the above layers was annealed at 135° C. in a forced air oven for 6 minutes.

Numerous other photoresponsive devices were prepared by repeating the procedures of the above examples with the exception that there was selected as the photogenerating layer a selenium tellurium alloy, containing 75 percent by weight of selenium, and 25 percent by weight of tellurium, or an arsenic selenium alloy, containing 99.99 percent by weight of selenium, and 0.1 percent by weight of arsenic.

Each of the above prepared devices were then tested for photosensitivity in the visible and infra-red region of the spectrum by negatively charging the devices with corona to a −800 volts, followed by simultaneously exposing each device to monochromatic light in a wavelength range of from about 400 to about 1,000 nanometers. The surface potential of each device was then measured with an electrical probe after exposure to given wavelengths. The percent discharge of each device was then calculated as disclosed hereinbefore, which percent discharge indicates photoresponse.

The photoresponse devices of Examples III, IV and V, responded to light only in the wavelength of about 400 to 675 nanometers, indicating visible photosensitivity, while the photoresponsive devices of Examples VI and VII, responded to light in the wavelength of about 580 to 950 nanometers, with poor response in the blue and green wavelength range of the spectrum.

The devices as prepared in Examples VIII to XIX, had excellent response in the wavelength range of from about 400 to about 950 nanometers, indicating both visible and infra-red photosensitivity for these devices.

Although the invention has been described with reference to specific preferred embodiments, it is not intended to be limited thereto, rather those skilled in the art will recognize variations and modifications may be made therein which are within the spirit of the invention and within the scope of the following claims.

I claim:

1. An improved photoresponsive device comprised of a substrate, a hole blocking layer, an optional adhesive layer, an inorganic photogenerating layer, an organic photoconductive layer sensitive to infra-red radiation, and a top coating of a hole transport layer.

2. An improved photoresponsive device in accordance with claim 1 comprised in the order stated of the following layers: (1) a substrate, (2) a metal oxide hole blocking layer, (3) an adhesive layer, (4) an inorganic photogenerating layer, (5) a photoconductive composition capable of enhancing or reducing the intrinsic properties of the photogenerating layer in the infra-red and/or visible region of the spectrum, which composition is selected from the group consisting of organic photoconductive compositions, charge transfer complex compositions, sensitizers, or mixtures thereof, and (6) a hole transport layer.

3. An improved photoresponsive device in accordance with claim 1 comprised in the order stated of the following layers: (1) a substrate, (2) metal oxide hole blocking layer, (3) an adhesive layer, (4) a photoconductive composition capable of enhancing or reducing the intrinsic properties of a photogenerating layer in the infra-red and/or visible region of the spectrum, which composition is selected from the group consisting of organic photoconductive compositions, charge transfer complex compositions, sensitizers, and mixtures thereof, (5) an inorganic photogenerating layer and, (6) a hole transport layer.

4. An improved photoresponsive device in accordance with claims 2 or 3 wherein the substrate is conductive, the metallic oxide is aluminum oxide, and the adhesive layer is comprised of a polyester resin.

5. An improved photoresponsive device in accordance with claims 2 or 3 wherein the photoconductive layer is comprised of an infra-red photoconductive material.

6. An improved photoresponsive device in accordance with claims 2 or 3 wherein the photoconductive material is a phthalocyanine pigment.

7. An improved photoresponsive device in accordance with claim 6 wherein the photoconductive material is vanadyl phthalocyanine.

8. An improved photoresponsive device in accordance with claim 6 wherein the photoconductive material is a metal free phthalocyanine.

9. An improved photoresponsive device in accordance with claim 6 wherein the photoconductive material is chloroaluminum phthalocyanine chloride.

10. An improved photoresponsive device in accordance with claim 6 wherein the photoconductive material is chlorogallium phthalocyanine chloride.

11. An improved photoresponsive device in accordance with claims 2 or 3 wherein the photoconductive material is a squarylium composition of the formula:

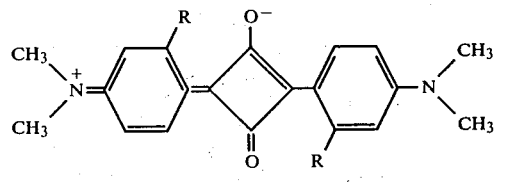

wherein R is hydrogen, an alkyl group, or a hydroxy (OH) group.

12. An improved photoresponsive device in accordance with claim 11 wherein the squarylium composition is a hydroxy squarylium or a methyl squarylium.

13. An improved photoresponsive device in accordance with claims 2 or 3 wherein the sensitizer is derived from the class of cyanine dye sensitizers, which cause sensitization in the infrared region.

14. An improved photoresponsive device in accordance with claims 2 or 3 wherein the photogenerating layer is comprised of selenium, a halogen doped selenium substance, selenium alloys, or halogen doped selenium alloys.

15. An improved photoresponsive device in accordance with claim 14 wherein the selenium alloys are comprised of selenium arsenic, and selenium tellurium.

16. An improved photoresponsive device in accordance with claim 15 wherein the selenium alloys are doped with chlorine in an amount of from about 50 parts per million to about 200 parts per million.

17. An improved photoresponsive device in accordance with claims 2 or 3 wherein the photogenerating layer is trigonal selenium.

18. An improved photoresponsive device in accordance with claims 2 or 3 wherein the photogenerating layer is trigonal selenium doped with sodium carbonate, and sodium selenite.

19. An improved photoresponsive device in accordance with claims 2 or 3 wherein the thickness of the adhesive layer is from about 0.01 to about 0.3 microns, the thickness of the photogenerating layer is from about 0.1 microns to about 10 microns, when the photogenerating layer contains from about 5 percent to about 100 percent by volume of photogenerating pigment, and the thickness of the photoconductive layer is from about 0.1 microns to about 10 microns, when the photoconductive composition contains from about 5 percent to about 100 percent by volume of photoconductive pigment.

20. An improved photoresponsive device in accordance with claims 2 or 3 wherein the photogenerating layer is comprised of an inorganic photoconductive composition dispersed in a resinous binder, and the photoconductive layer is comprised of an organic photoconductive composition dispersed in a resinous binder.

21. An improved photoresponsive device in accordance with claim 20 wherein the resinous binder for the photogenerating layer is a poly(hydroxyether).

22. An improved photoresponsive device in accordance with claim 20 wherein the resinous binder for the photogenerating layer is a polyvinylcarbazole.

23. An improved photoresponsive device in accordance with claim 20 wherein the binder for the photoconductive layer is a polycarbonate.

24. An improved photoresponsive device in accordance with claim 19 wherein the binder for the photoconductive layer is a polyester.

25. An improved photoresponsive device in accordance with claim 19 wherein the binder for the photoconductive layer is polyvinylcarbazole.

26. An improved photoresponsive device in accordance with claims 2 or 3 wherein the charge transport layer comprises molecules of the formula:

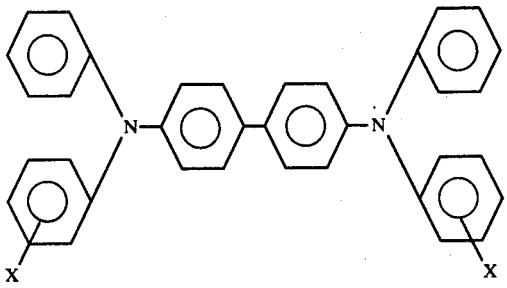

dispersed in a highly insulating and transparent organic resinous material wherein X is selected from the group consisting of (ortho) $CH_3$, (meta)$CH_3$, (para)$CH_3$, (ortho)Cl, (meta)Cl, (para)Cl.

27. An improved photoresponsive device in accordance with claim 26 wherein the transport layer is comprised of N,N'-diphenyl-N,N'-bis(3-methylphenyl)-[1,1-biphenyl]-4,4'-diamine.

28. An improved photoresponsive device in accordance with claim 19 wherein the resinous binder is a polycarbonate having a molecular weight of from about 20,000 to about 100,000.

29. An improved photoresponsive device in accordance with claim 26 wherein the resinous binder contains from about 10 percent by weight to about 75 percent by weight of the diamine compound, and the thickness of the charge transport layer is from about 5 microns to about 50 microns.

30. An improved photoresponsive device in accordance with claims 2 or 3 wherein the substrate is comprised of indium tin oxide.

* * * * *